US010862205B2

(12) United States Patent
Wilkins et al.

(10) Patent No.: US 10,862,205 B2
(45) Date of Patent: Dec. 8, 2020

(54) PATCH ANTENNA

(71) Applicant: Cambium Networks Ltd, Ashburton, Devon (GB)

(72) Inventors: Adam Wilkins, Devon (GB); Paul Clark, Paignton (GB); Carl Morrell, Devon (GB)

(73) Assignee: CAMBIUM NETWORKS LTD, Ashburton (GB)

( * ) Notice: Subject to any disclaimer, the term of this patent is extended or adjusted under 35 U.S.C. 154(b) by 308 days.

(21) Appl. No.: 15/940,097

(22) Filed: Mar. 29, 2018

(65) Prior Publication Data

US 2018/0219283 A1 Aug. 2, 2018

Related U.S. Application Data

(63) Continuation of application No. PCT/GB2016/053008, filed on Sep. 28, 2016.

(30) Foreign Application Priority Data

Sep. 29, 2015 (GB) ..... 1517222.4

(51) Int. Cl.
*H01Q 1/52* (2006.01)
*H01Q 21/24* (2006.01)
(Continued)

(52) U.S. Cl.
CPC ..... *H01Q 1/523* (2013.01); *H01Q 5/35* (2015.01); *H01Q 9/045* (2013.01); *H01Q 21/24* (2013.01); *H01Q 25/001* (2013.01)

(58) Field of Classification Search
CPC ..... H01Q 9/0435; H01Q 5/35; H01Q 19/005; H01Q 9/0478; H01Q 9/045
See application file for complete search history.

(56) References Cited

U.S. PATENT DOCUMENTS 4,291,312 A 9/1981 Kaloi
4,749,996 A * 6/1988 Tresselt ..... H01Q 9/0414 343/700 MS
(Continued)

FOREIGN PATENT DOCUMENTS

CN 103311664 A 9/2013
EP 0279050 A1 8/1988
(Continued)

OTHER PUBLICATIONS

International Search Report and Written Opinion of the International Searching Authority in International Pat. Appln. No. PCT/GB2016/053008, dated Feb. 7, 2017.

*Primary Examiner* — Ricardo I Magallanes
(74) *Attorney, Agent, or Firm* — Brinks Gilson & Lione

(57) ABSTRACT

A dual polarised edge coupled patch antenna element includes a patch radiator (1) and a ground plane (6), the ground plane being disposed in a substantially parallel relationship with the patch radiator (1). A first feed track (2) is connected at a first feed position on a first edge of the patch radiator and a second feed track (3) is connected at a second feed position on a second edge of the patch radiator, the second edge being at a right angle to the first edge. The first feed position is offset from the centre of the first edge and the second feed position is offset from the centre of the second edge, and the first feed position and the second feed position are each offset in a respective direction away from a corner between the first side and the second side.

19 Claims, 7 Drawing Sheets

(51) Int. Cl.

| | |
|---|---|
| ***H01Q 5/35*** | (2015.01) |
| ***H01Q 9/04*** | (2006.01) |
| ***H01Q 25/00*** | (2006.01) |

(56) References Cited

U.S. PATENT DOCUMENTS

| | | | | |
|---|---|---|---|---|
| 5,216,430 | A * | 6/1993 | Rahm | H01Q 9/0435 343/700 MS |
| 5,617,103 | A | 4/1997 | Koscica et al. | |
| 2004/0239567 | A1* | 12/2004 | Van Der Poel | H01Q 9/0414 343/700 MS |
| 2006/0139215 | A1* | 6/2006 | Heiniger | H01Q 9/0478 343/700 MS |
| 2006/0290570 | A1* | 12/2006 | Hilgers | H01Q 1/38 343/700 MS |
| 2009/0256777 | A1 | 10/2009 | Nagai | |
| 2010/0302104 | A1 | 12/2010 | Luk et al. | |
| 2013/0187830 | A1 | 7/2013 | Warnick et al. | |

FOREIGN PATENT DOCUMENTS

| | | | |
|---|---|---|---|
| EP | 1437795 | A1 | 7/2004 |
| WO | 2004-045020 | A1 | 5/2004 |
| WO | 2005-022685 | A1 | 3/2005 |
| WO | 2011-063273 | A1 | 5/2011 |

* cited by examiner

PATCH ANTENNA

CROSS-REFERENCE TO RELATED APPLICATIONS

This application is a continuation of International Patent Application No. PCT/GB2016/053008, filed Sep. 28, 2016, designating the United States and published in English, which claims priority to United Kingdom Patent Application No. GB 1517222.4, filed Sep. 29, 2015, the entire disclosures of each of which are incorporated herein by reference.

TECHNICAL FIELD

The present disclosure relates generally to radio antennas, and more specifically, but not exclusively, to a dual polarised edge coupled patch antenna element for the transmission and/or reception of microwave frequencies in a wireless communications system and a method of manufacturing thereof.

BACKGROUND

Modern wireless communications systems place great demands on the antennas used to transmit and receive signals. Antennas may be required to produce a radiation pattern with a carefully tailored and well defined beamwidth in azimuth and elevation, while maintaining high gain characteristics and operating over a broad bandwidth. Antennas may be required to transmit and/or receive signals on one or both of two orthogonal polarisations. It is typically required to provide isolation between polarisations, so that a signal intended for transmission or reception at one polarisation is isolated from transmission or reception at the other polarisation.

A patch antenna is a type of antenna that may typically be used in a wireless communications system such as a fixed wireless access system, for example at a base station or at a user equipment terminal, such as customer premises equipment. A patch antenna typically comprises a sheet of metal known as a patch radiator, disposed in a substantially parallel relationship to a ground plane. There may be a dielectric material between the patch radiator and the ground plane, such as a typical printed circuit board substrate comprising, for example, a composite of glass fibre and resin, or there may be an air dielectric, in which case the patch radiator may be held in position in relation to the ground plane by non-conducting spacers, for example. The patch radiator may be, for example, rectangular with one side of approximately half a wavelength in length at an operating frequency of the antenna, and is typically connected to a radio transceiver by a feed track or tracks of defined characteristic impedance, typically 50 Ohms. To form a dual polar patch antenna, respective feed tracks may be provided for each polarisation on adjacent sides of the patch radiator. Each feed track may connect to the patch antenna at a respective feed point on an edge of the patch radiator and the feed tracks are typically formed in the same plane as the patch radiator. For example, the feed track and patch radiator may be formed as etched copper areas on one side of a printed circuit board, and the ground plane may be formed on the other side.

However, typical dual polar patch antennas have limited isolation between polarisations.

It is an object of the disclosure to mitigate the problems of the prior art.

SUMMARY

In accordance with a first aspect of the disclosure, there is provided a dual polarised edge coupled patch antenna element. The dual polarised edge coupled patch antenna element includes a patch radiator. The dual polarised edge coupled patch antenna element further includes a ground plane, the ground plane being disposed in a substantially parallel relationship with the patch radiator. The dual polarised edge coupled patch antenna element further includes a first feed track connected at a first feed position on a first edge of the patch radiator. The dual polarised edge coupled patch antenna element further includes a second feed track connected at a second feed position on a second edge of the patch radiator, the second edge being at a right angle to the first edge. The first feed position is offset from the centre of the first edge and the second feed position is offset from the centre of the second edge. The first feed position and the second feed position are each offset in a respective direction away from a corner between the first side and the second side.

This allows an improved isolation to be provided between polarisations.

In an embodiment of the disclosure, the patch radiator is substantially square, each side having a length being within +/−25% of half a wavelength at an operating frequency of the patch antenna element.

This allows a good impedance match and provides similar radiation patterns for each polarisation.

In an embodiment of the disclosure, the offset of the first feed position from the centre of the first edge is between 5% and 15% of the length of the first edge and the offset of the second feed position from the centre of the second edge is between 5% and 15% of the length of the second edge.

This allows improved isolation between polarisations to be achieved.

In an embodiment of the disclosure, the second feed position is at a null in a distribution of radio frequency voltages in the patch radiator for a feed at the first feed position, and the first feed position is at a null in a distribution of radio frequency voltages in the patch radiator for a feed at the second feed position.

This allows improved isolation between polarisations to be achieved.

In accordance with a second aspect of the present disclosure, there is provided a method of manufacturing a dual polarised edge coupled patch antenna element. The patch antenna element includes a patch radiator and a ground plane disposed in a substantially parallel relationship with the patch radiator. The method includes determining a first feed position on a first edge of the patch radiator and a second feed position on a second edge of the patch radiator, the second edge being at a right angle to the first edge, such that the second feed position is at a null in a distribution of radio frequency voltages in the patch radiator for a feed at the first feed position, and the first feed position is at a null in a distribution of radio frequency voltages in the patch radiator for a feed at the second feed position. The method further includes manufacturing a dual polarised edge coupled patch antenna element having a feed at the first feed position for a signal for transmission and/or reception at a first polarisation and a feed at the second feed position for a signal for transmission and/or reception at a second polarisation.

This allows dual polarised edge coupled patch antenna element to be manufactured which provides improved isolation between polarisations.

In an embodiment of the disclosure, determining the first and second feed positions includes iteratively updating the position of the edge coupled feed on the first side and the position of the edge coupled feed on the second side to determine a second feed position that is at a null in the distribution of radio frequency voltages in the patch radiator for a feed at the first feed position, and a first feed position that is at a null in the distribution of radio frequency voltages in the patch radiator for a feed at the second feed position.

This provides an effective method of determining the position of the edge coupled feeds in order to provide improved isolation between polarisations.

In an embodiment of the disclosure, the method further includes: determining a first distribution of radio frequency voltages in the patch radiator for an edge coupled feed at an arbitrary position on a first edge of the patch radiator, the arbitrary position being offset from the centre of the first edge; determining a first null point on a second edge of the patch radiator in the first distribution of radio frequency voltages, the second edge being at a right angle to the first edge; determining a second distribution of radio frequency voltages in the patch radiator for an edge coupled feed at the first null point; and determining a second null point on the first edge of the patch antenna in the second distribution of radio frequency voltages.

This provides an effective method of determining the position of the edge coupled feeds in order to provide improved isolation between polarisations.

In an embodiment of the disclosure, the patch radiator includes a slot on each side of each feed position, the slot extending into the patch radiator.

This allows an improved impedance match.

In an embodiment of the disclosure, the patch radiator is substantially square, each side having a length being within +/−25% of half a wavelength at an operating frequency of the patch antenna element.

This provides similar radiation characteristics for each polarisation.

In an embodiment of the disclosure, the ground plane is provided by a metal plate, and the patch radiator comprises a conductive layer supported by a non-conductive film.

This allows the antenna to operate with an air dielectric between the ground plane and the patch antenna, reducing loss.

In an embodiment of the disclosure, the patch antenna element comprises a director element disposed in a substantially parallel relationship with the patch radiator, spaced from the patch radiator in a direction away from the ground plane, wherein determining the first and second feed positions comprises determining a respective distribution of radio frequency voltages in the patch radiator in the presence of the director element.

This allows a broader band impedance match to be achieved to the patch antenna element.

In accordance with a third aspect of the disclosure, there is provided a dual polarised edge coupled patch antenna element manufactured by the claimed method.

Further features and advantages of the disclosure will be apparent from the following description of preferred embodiments of the disclosure, which are given by way of example only.

DETAILED DESCRIPTION

By way of example, embodiments of the disclosure will now be described in the context of an antenna for a broadband fixed wireless access radio communications system operating in accordance with an IEEE 802.11a, b, g, n or ac standard. However, it will be understood that this is by way of example only and that other embodiments may involve other wireless systems, and may apply to point-to-point and point-to-multipoint systems.

Figure 1:
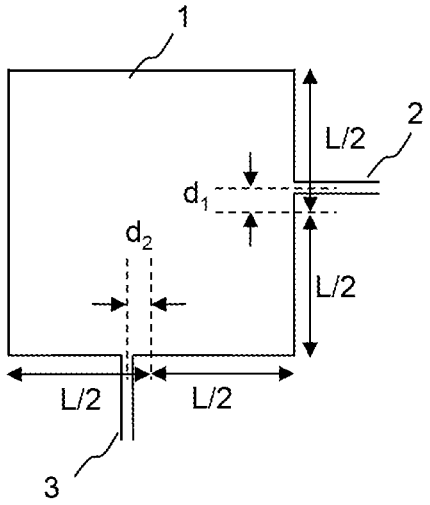
FIG. 1 is a schematic diagram showing a dual polarised edge coupled patch antenna element in an embodiment of the disclosure.

FIG. 1 shows a dual polarised edge coupled patch antenna element according to an embodiment of the disclosure, comprising a patch radiator 1, a first feed track 2 connected at a first feed position on a first edge of the patch radiator, and a second feed track 3 connected at a second feed position on a second edge of the patch radiator. As can be seen from FIG. 1, the second edge is at a right angle to the first edge. The first feed track 2 is for connecting signals to the patch radiator for transmission and/or reception at a first polarisation, and the second feed track 3 is for connecting signals to the patch radiator for transmission and/or reception at a second polarisation. It has been found that isolation between the first and second polarisation can be improved by offsetting the first feed position from the centre of the first edge and offsetting the second feed position from the centre of the second edge. The isolation between polarisations may be expressed in terms of the amount of radiation that is transmitted or received on the un-intended polarisation in comparison with that transmitted or received on the intended polarisation. As shown in FIG. 1, an offset $d_1$ is provided between the centre of the first feed and the centre of the first edge, and an offset $d_2$ is provided between the centre of the second feed and the centre of the second edge. Typically, $d_1$ is the same as $d_2$. The feeds are offset away from each other, so that the first feed position and the second feed position are each offset in a direction away from a corner between the first side and the second side. It has been found that particularly good isolation between polarisations may be achieved if the offset of the first feed position from the centre of the first edge is between 5% and 15% of the length of the first edge and the offset of the second feed position from the centre of the second edge is between 5% and 15% of the length of the second edge. An offset of between 7 and 10% of the length L of each edge has been found to produce very good isolation. The patch radiator is typically substantially square, each edge having a length within +/−25% of half a wavelength at an operating frequency of the patch antenna element, which may give a good impedance match and provide similar radiation patterns for each polarisation. The operating frequency may be typically in the region 5-6 GHz, but the operating frequency is not restricted to this range.

The improved isolation between polarisations may be achieved by arranging for each feed position to be at or near a null in the distribution of radio frequency voltages that would be caused by feeding a radio frequency signal into the feed for the other polarisation, at an operating frequency of the patch antenna element. So, the second feed position may be placed at or adjacent to a null in a distribution of radio frequency voltages in the patch radiator for a feed at the first feed position, and the first feed position may be placed at or adjacent to a null in a distribution of radio frequency voltages in the patch radiator for a feed at the second feed position. A null is a minimum or a local minimum in a distribution, and is typically non-zero in magnitude.

A mechanism for coupling between polarisations is believed to be as follows. A signal provided to a feed point for radiation at a first polarisation may be coupled to the feed point for the second polarisation by transmission through the patch radiator. Impedance mis-matches in the feed for the second polarisation may reflect the signal back into the patch radiator. This results in the signal being radiated from the patch radiator at the second polarisation in addition to being radiated at the first polarisation. The difference in power between the signal radiated at the second polarisation and that radiated at the first polarisation may be referred to as the polarisation isolation.

By arranging each feed point, that is to say the feed position of each feed track, to be at or near a null in the radio frequency voltage distribution, that is to say at or near a null in the radio frequency signal distribution, or power distribution, that would be caused by a signal fed to the other feed point, an improved polarisation isolation may be achieved, and a polarisation isolation of 20 dB or more may be achieved.

The determination of the position of a null in the voltage distribution in the patch radiator may be determined by calculation of standing wave positions within the patch radiator using well-known mathematical relationships, by computer modelling of radio frequency voltages, or by physical measurement of prototype devices. In each case, the determination may be performed iteratively, by perturbing the offset of a feed from the centre of a side, and calculating or measuring the position of a null in the voltage distribution characteristic at or near to the adjacent side, changing the offset of the feed in a direction that would move the other feed closer to a null, and so on. It could be determined that the other feed is at or close to a null by measuring the amount of a radio frequency signal fed into one feed that is coupled out of the other feed. The offset of the feed positions may be adjusted iteratively to increase the radio frequency signal loss of a signal that is fed into one feed, when received out from the other feed.

The dual polarised edge coupled patch antenna element comprises a ground plane, not shown in the top view of the patch antenna element in FIG. 1, that is disposed in a substantially parallel relationship with the patch radiator. Radiation from and/or to the patch radiator is transmitted in a direction away from the ground plane and/or received in a direction towards the ground plane.

Figure 2:
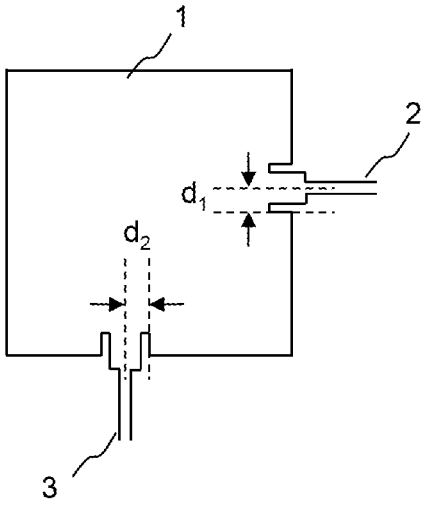
FIG. 2 is a schematic diagram showing a dual polarised edge coupled patch antenna element comprising a slot on each side of each feed position in an embodiment of the disclosure.

FIG. 2 shows a dual polar edge fed patch antenna element in an embodiment of the disclosure, in which the patch radiator 1 comprises a slot on each side of each feed position, the slot extending into the patch radiator. This allows an improved impedance match.

Figure 3:
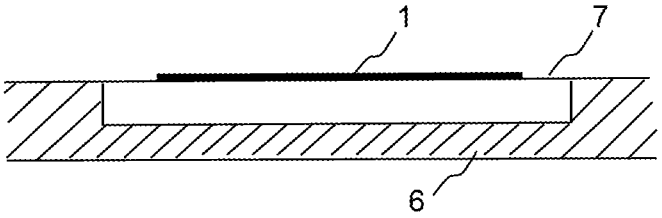
FIG. 3 is a cross-sectional view of a dual polarised patch antenna in an embodiment of the disclosure.

FIG. 3 is a cross-sectional view of a dual polarised patch antenna element in an embodiment of the disclosure. The patch antenna element comprises a patch radiator 1, and a ground plane. The ground plane may be provided by a plate 6, typically composed of a metal such as aluminium, which may have a recessed portion underlying the patch radiator. The patch radiator 1 may comprise a conductive layer and be supported by a non-conductive film 7, so that the antenna may operate with an air dielectric between the ground plane and the patch antenna, reducing loss. The patch radiator may alternatively be a printed copper layer on one side of a printed circuit board and the ground plane may be a copper layer on the other side of the printed circuit board. There are many alternative mechanical arrangements by which the patch radiator may be held in a substantially parallel relationship to the ground plane, for example by the use of a foam layer or by the use of stand-off spacing pillars.

Figure 4:
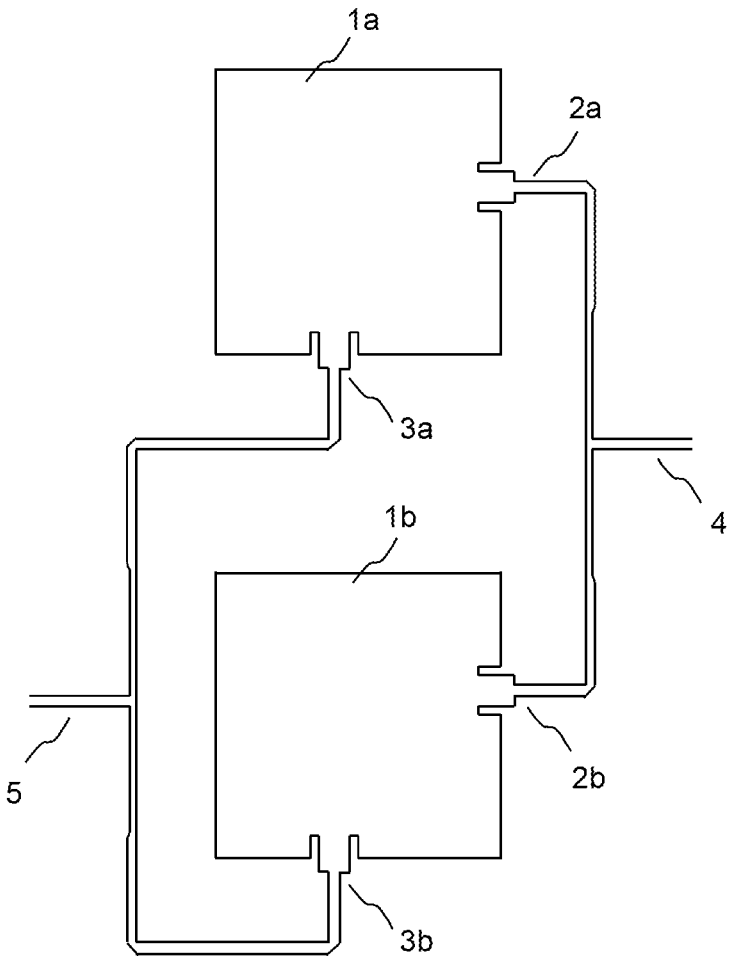
FIG. 4 is a schematic diagram showing an array of two dual polarised edge coupled patch antenna elements in an embodiment of the disclosure.

FIG. 4 shows an array of two dual polarised edge coupled patch antenna elements in an embodiment of the disclosure. A first patch radiator 1*a* and a second patch radiator 1*b* are arranged with a spacing between the patch antennas elements arranged so that the array forms a combined beam of narrower beamwidth than that of an individual patch antenna element, in a plane intersecting the patch radiators along an axis of the array. A signal feed track 4 for transmission and/or reception at a first polarisation is connected to a feed track 2*a* on the first patch radiator and a feed track 2*b* on the second patch radiator, and a signal feed track 5 for transmission and/or reception at a second polarisation is connected to a feed track 3*a* on the first patch radiator and a feed track 3*b* on the second patch radiator. The patch radiators and feed tracks may be formed a printed structures in a copper layer carried by a non-conductive film, or by a printed circuit board substrate, such as a board comprising an epoxy-glass composite material, for example.

Each patch antenna element has a dual polarised edge coupled patch radiator with offset feeds as per FIG. 1-3, so that signals fed in at track feed track 4 for transmission at a first polarisation are isolated from being transmitted on the second polarisation, typically by 20 dB or more, and signals fed in at track feed track 5 for transmission at a second polarisation are isolated from being transmitted on the first polarisation. Similarly, polarisation isolation is provided on reception.

Figure 5:
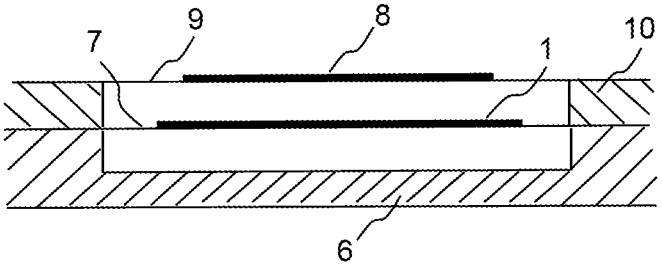
FIG. 5 is a cross-sectional view of a dual polarised patch antenna comprising a director element in an embodiment of the disclosure.

FIG. 5 is a cross-sectional view of a dual polarised patch antenna element comprising a director element 8 in an embodiment of the disclosure. The director element 8 is disposed in a substantially parallel relationship with the patch radiator 1, spaced from the patch radiator in a direction away from the ground plane. The director element may allow an improved broadband impedance match to be achieved to the patch antenna element. The director element may be substantially square, each side having a length of less than the length of any side of the patch radiator. The presence of the director element may be taken into account when determining the distribution of radio frequency voltages for determining the first and second feed positions on the patch radiator. This may be by mathematical calculation, by computer simulation, or by measurement of prototype units. As may be seen in FIG. 5, the director element 8 may comprise a conductive layer supported by a non-conductive film 9, which is supported by a spacer 10, which may be composed of metal.

Figure 6:
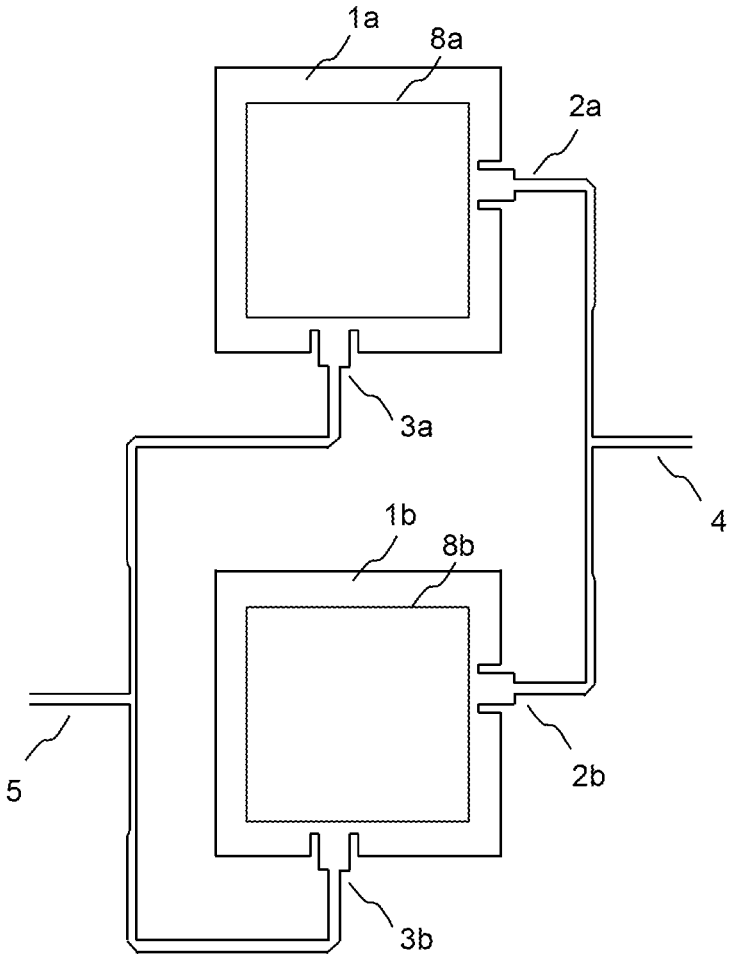
FIG. 6 is a schematic diagram showing an array of two dual polarised edge coupled patch antenna elements, each comprising a director element, in an embodiment of the disclosure.
Figure 7:
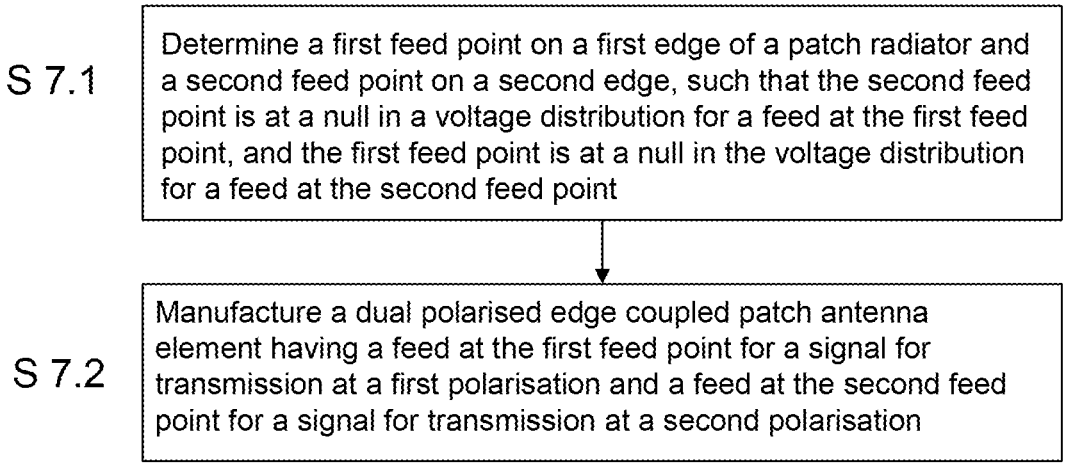
FIG. 7 is a flow diagram illustrating a method of manufacture of a dual polarised edge coupled patch antenna element.

FIG. 6 shows an array of two dual polarised edge coupled patch antenna elements, each comprising a director element, in an embodiment of the disclosure. Similarly to FIG. 4, this is a top view, showing that director element 8*a* and 8*b* overlie the corresponding patch radiator elements 1*a* and 1*b*, which themselves overlie a ground plane (not shown).

In order to manufacture a dual polarised edge coupled patch antenna element as already described, the positions of the feed tracks for the two polarisation may be determined first, and then a patch antenna element may be manufactured with feeds at the determined positions using conventional techniques. The patch radiator and feed tracks may be manufactured, for example, by conventional techniques for producing printed circuits. Typically, an etch resistant mask is mask is applied to a copper layer carried by a non-conductive substrate such a polyester film or an epoxy-glass composite board. The etch resistant mask is formed in the shape of the patch radiator and feed tracks. The unwanted copper that is not covered is then chemically removed by etching. The ground plane may be formed as shown in FIG. 3 as plate 6, which may be formed from metal such as aluminium, with a cast or milled recess formed under the patch radiator 6. Alternatively, the plate may be formed as a plastic moulding with a conductive metal surface. The recess may be approximately 4 mm in depth. The non-conductive film 7 supporting the patch radiator 1 and feed tracks may be supported by the metal plate and may be held in place by pips or projections which locate into corresponding holes formed in the film. In alternative embodiments, the patch radiator and/or feed tracks may be formed by stamping from a metal sheet such as copper or brass.

At the design stage of the manufacturing process, the first feed position is determined on a first edge of the patch antenna element for a signal for transmission at a first polarisation and the second feed position is determined on the second edge of the patch antenna element for a signal for transmission at a first polarisation, as has been already described, such that the second feed position is at a null in a distribution of radio frequency voltages in the patch antenna element for a feed at the first feed position, and the first feed position is at a null in a distribution of radio frequency voltages in the patch antenna element for a feed at the second feed position.

Determining the first and second feed positions may comprise iteratively updating the position of the edge coupled feed on the first side and the position of the edge coupled feed on the second side to determine a second feed position that is at a null in the distribution of radio frequency voltages in the patch antenna element for a feed at the first feed position, and a first feed position that is at a null in the distribution of radio frequency voltages in the patch antenna element for a feed at the second feed position. For example, a first distribution of radio frequency voltages in the patch antenna element may be determined for an edge coupled feed at an arbitrary position on a first edge of the patch antenna element, the arbitrary position being offset from the centre of the first edge. A first null point may be determined in the radio frequency voltage distribution on a second edge of the patch antenna, the second edge being at a right angle to the first edge, and then a distribution of radio frequency voltages may be determined in the patch antenna element for an edge coupled feed at the first null point. A second null point may be determined in the radio frequency voltage distribution on a first edge of the patch antenna for the edge coupled feed at the first null point. This process may be repeated iteratively, at each iteration changing an offset of a feed position in a direction expected, on the basis of previous iterations, to move the null closer to the other feed position. This provides an effective method of determining the position of the edge coupled feeds in order to provide improved isolation between polarisations.

From the foregoing description, it can be seen that a patch antenna is a type of radio antenna with a low profile, which can be mounted on a flat surface. It may consist of a flat rectangular sheet or "patch" of metal, mounted over a larger sheet of metal called a ground plane. The assembly may be contained inside a plastic radome, which protects the antenna structure from damage. The metal sheet above the ground plane may be viewed as forming a resonant piece of microstrip transmission line with a length of approximately one-half wavelength of the radio waves. The radiation mechanism may be viewed as arising from discontinuities at each truncated edge of the microstrip transmission line. The radiation at the edges may cause the antenna to act slightly larger electrically than its physical dimensions, so in order for the antenna to be resonant, a length of microstrip transmission line slightly shorter than one-half a wavelength at the frequency may used to form the patch.

The above embodiments are to be understood as illustrative examples of the disclosure. It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

What we claim is:

1. A dual polarised edge coupled patch antenna element comprising:

a patch radiator;

a ground plane, the ground plane being disposed in a substantially parallel relationship with the patch radiator;

a first feed track connected to the patch radiator at a first feed position on a first edge of the patch radiator to connect first signals to the patch radiator for at least one of transmission or reception at a first polarisation;

a second feed track connected to the patch radiator at a second feed position on a second edge of the patch radiator to connect second signals to the patch radiator for at least one of transmission or reception at a second polarisation, the second edge being at a right angle to the first edge, wherein the first feed position is offset from a centre of the first edge and the second feed position is offset from a centre of the second edge, and the first feed position and the second feed position each being offset in a respective direction away from a corner between a first side and a second side to provide isolation against at least one of transmission or reception of the first signals at the second polarisation and to provide isolation against at least one of transmission or reception of the second signals at the first polarisation.

2. The dual polarised edge coupled patch antenna element of claim 1, wherein the patch radiator is substantially square, each side having a length being within +/−25% of half a wavelength at an operating frequency of the patch antenna element.

3. The dual polarised edge coupled patch antenna element of claim 1, wherein the offset of the first feed position from the centre of the first edge is between 5% and 15% of a length of the first edge and the offset of the second feed position from the centre of the second edge is between 5% and 15% of a length of the second edge.

4. The dual polarised edge coupled patch antenna element of claim 1, wherein the second feed position is at a null in a distribution of radio frequency voltages in the patch radiator for a feed at the first feed position, and the first feed position is at a null in a distribution of radio frequency voltages in the patch radiator for a feed at the second feed position.

5. The dual polarised edge coupled patch antenna element of claim 1, wherein the ground plane is provided by a metal plate, and the patch radiator comprises a conductive layer supported by a non-conductive film.

6. The dual polarised edge coupled patch antenna element of claim 1, comprising a director element disposed in a substantially parallel relationship with the patch radiator, spaced from the patch radiator in a direction away from the ground plane.

7. The dual polarised edge coupled patch antenna element of claim 6, wherein the director element is substantially square, each side having a length of less than the length of any side of the patch radiator.

8. The dual polarised edge coupled patch antenna element of claim 6, wherein the director element comprises a conductive layer supported by a non-conductive film.

9. The dual polarised edge coupled patch antenna element of claim 1, wherein the patch radiator comprises a slot on each side of each feed position, the slot extending into the patch radiator.

10. A method of manufacturing a dual polarised edge coupled patch antenna element, the patch antenna element comprising a patch radiator and a ground plane disposed in a substantially parallel relationship with the patch radiator, the method comprising:

determining a first feed position of a first feed track connected to the patch radiator on a first edge of the patch radiator to connect first signals to the patch radiator for at least one of transmission or reception at a first polarisation and a second feed position of a second feed track connected to the patch radiator on a second edge of the patch radiator to connect second signals to the patch radiator for at least one of transmission or reception at a second polarisation, the second edge being at a right angle to the first edge, such that the second feed position is at a null in a distribution of radio frequency voltages in the patch radiator for a feed at the first feed position, and the first feed position is at a null in a distribution of radio frequency voltages in the patch radiator for a feed at the second feed position to provide isolation against at least one of transmission or reception of the first signals at the second polarisation and to provide isolation against at least one of transmission or reception of the second signals at the first polarisation; and manufacturing a dual polarised edge coupled patch antenna element having a feed at the first feed position for a signal for at least one of transmission or reception at a first polarisation and a feed at the second feed position for a signal for at least one of transmission or reception at a second polarisation.

11. The method of claim 10, wherein determining the first and second feed positions comprises iteratively updating the position of the edge coupled feed on a first side and the position of the edge coupled feed on a second side to determine a second feed position that is at a null in the distribution of radio frequency voltages in the patch radiator for a feed at the first feed position, and a first feed position that is at a null in the distribution of radio frequency voltages in the patch radiator for a feed at the second feed position.

12. The method of claim 11, comprising:

determining a first distribution of radio frequency voltages in the patch radiator for an edge coupled feed at an arbitrary position on a first edge of the patch radiator, the arbitrary position being offset from a centre of the first edge;

determining a first null point on a second edge of the patch radiator in the first distribution of radio frequency voltages, the second edge being at a right angle to the first edge;

determining a second distribution of radio frequency voltages in the patch radiator for an edge coupled feed at the first null point; and determining a second null point on the first edge of the patch antenna in the second distribution of radio frequency voltages.

13. The method of claim 10, wherein the patch radiator comprises a slot on each side of each feed position, the slot extending into the patch radiator.

14. The method of claim 10, wherein the patch radiator is substantially square, each side having a length being within +1-25% of half a wavelength at an operating frequency of the patch antenna element.

15. The method of claim 10, wherein the ground plane is provided by a metal plate, and the patch radiator comprises a conductive layer supported by a non-conductive film.

16. The method of claim 10, wherein the patch antenna element comprises a director element disposed in a substantially parallel relationship with the patch radiator, spaced from the patch radiator in a direction away from the ground plane, wherein determining the first and second feed positions comprises determining a respective distribution of radio frequency voltages in the patch radiator in the presence of the director element.

17. The method of claim 16, wherein the director element is substantially square, each side having a length of less than the length of any side of the patch radiator.

18. The method of claim 16, wherein the director element comprises a conductive layer supported by a non-conductive film.

19. A dual polarised edge coupled patch antenna element manufactured by the method of claim 10.

* * * * *